US011206863B2

(12) United States Patent
Freeman

(10) Patent No.: US 11,206,863 B2
(45) Date of Patent: Dec. 28, 2021

(54) VEGETABLE BASED TOBACCO ALTERNATIVES AND ARTICLES COMPRISING SAME

(76) Inventor: Steven R. Freeman, Bowling Green, KY (US)

( * ) Notice: Subject to any disclaimer, the term of this patent is extended or adjusted under 35 U.S.C. 154(b) by 808 days.

(21) Appl. No.: 13/992,132

(22) PCT Filed: Dec. 6, 2011

(86) PCT No.: PCT/US2011/063481

§ 371 (c)(1),
(2), (4) Date: Mar. 27, 2014

(87) PCT Pub. No.: WO2012/078597

PCT Pub. Date: Jun. 14, 2012

(65) Prior Publication Data

US 2014/0216481 A1 Aug. 7, 2014

Related U.S. Application Data

(60) Provisional application No. 61/420,590, filed on Dec. 7, 2010.

(51) Int. Cl.
*A24B 15/16* (2020.01)
*A24D 1/18* (2006.01)

(52) U.S. Cl.
CPC ..... *A24B 15/16* (2013.01); *A24D 1/18* (2013.01)

(58) Field of Classification Search
CPC ..... A24D 1/18
See application file for complete search history.

(56) References Cited

U.S. PATENT DOCUMENTS

| | | | | |
|---|---|---|---|---|
| 2,907,686 A | | 10/1959 | Slegel | |
| 2,930,719 A | * | 3/1960 | Finberg | A24B 15/16 131/275 |
| 2,943,958 A | | 7/1960 | Schaflander | |
| 2,943,959 A | | 7/1960 | Schaflander | |
| 3,034,931 A | | 5/1962 | Kiefer | |
| 3,100,492 A | | 8/1963 | Schmidt | |
| 3,106,209 A | * | 10/1963 | Torigian | A24B 15/16 131/369 |
| 3,112,754 A | | 12/1963 | Diaz | |
| 3,255,760 A | | 6/1966 | Selke | |
| 3,323,524 A | | 6/1967 | Shamberger | |
| 3,369,352 A | | 2/1968 | Carroll | |

(Continued)

FOREIGN PATENT DOCUMENTS

| | | |
|---|---|---|
| DE | 30 25 213 A1 | 1/1982 |
| DE | 41 36 405 A1 | 5/1993 |

OTHER PUBLICATIONS

International Search Report for PCT/US2011/063481, dated Apr. 4, 2012 (3 pages).

(Continued)

*Primary Examiner* — Eric Yaary
(74) *Attorney, Agent, or Firm* — Ballard Spahr LLP

(57) ABSTRACT

Disclosed are compositions suitable for use as alternatives or substitutes for natural tobacco. Disclosed compositions include combustible products comprising leafy material from one or more plants classified in the brassicaceae or spinnacia plant family. Also disclosed are methods for the manufacture and use of the disclosed compositions.

4 Claims, 2 Drawing Sheets

(56) References Cited

U.S. PATENT DOCUMENTS 3,369,551 A * 2/1968 Carroll ..... A24B 15/16 131/359
3,369,552 A 2/1968 Carroll
3,372,703 A 3/1968 Conard
3,434,171 A 3/1969 Lischer
3,491,766 A 1/1970 Ward
3,545,448 A 12/1970 Morman
3,575,177 A 4/1971 Briskin
3,638,660 A * 2/1972 Davis ..... A24B 15/16 131/334
3,702,615 A 11/1972 Rozacky
3,703,177 A 11/1972 Hind
3,705,589 A 12/1972 Orzman
3,720,660 A 3/1973 Arendt
3,738,374 A 6/1973 Bennett
4,582,709 A * 4/1986 Peters ..... A23G 3/362 424/601
4,813,438 A 3/1989 Fleming
5,368,873 A * 11/1994 Aebi ..... A23B 7/0205 426/303
5,723,167 A * 3/1998 Lewis ..... A23B 7/02 426/524
5,992,421 A * 11/1999 Bae ..... A24B 15/16 131/352
6,436,450 B1 * 8/2002 Omary ..... A23L 19/01 424/755
6,619,293 B1 9/2003 Siadto
2003/0099730 A1 * 5/2003 Rosenbloom ..... A61K 36/185 424/755
2005/0214383 A1 * 9/2005 Bubnis ..... A61K 31/355 424/641
2006/0062875 A1 * 3/2006 Gopal ..... A23K 40/30 426/106
2008/0193590 A1 * 8/2008 Lundberg ..... A21D 2/188 426/2
2009/0032040 A1 * 2/2009 Luzenberg, Jr. ..... A24B 13/00 131/359
2009/0050165 A1 2/2009 Murali
2009/0311352 A1 * 12/2009 Liu ..... A01N 65/12 424/755
2010/0200008 A1 * 8/2010 Taieb ..... A24F 47/008 131/360
2011/0091618 A1 * 4/2011 Wang ..... A23B 7/022 426/267
2014/0216481 A1 8/2014 Freeman

OTHER PUBLICATIONS

Written Opinion for PCT/US2011/063481, dated Apr. 4, 2012 (5 pages).
International Preliminary Report on Patentability for PCT/US2011/063481, dated Jun. 12, 2013 (6 pages).
U.S. Appl. No. 62/325,650, filed Apr. 21, 2016, Freeman.
U.S. Appl. No. 15/493,470, filed Apr. 21, 2017, Freeman.
PCT/US2011/063481, filed Dec. 6, 2011, Freeman.

* cited by examiner

VEGETABLE BASED TOBACCO ALTERNATIVES AND ARTICLES COMPRISING SAME

CROSS REFERENCE TO RELATED APPLICATIONS

The present application is a National Phase Application of International Application No. PCT/US2011/063481, filed Dec. 6, 2011, which claims priority to U.S. Provisional Patent Application No. 61/420,590, filed Dec. 7, 2010, which applications are incorporated herein fully by this reference.

BACKGROUND

Many decades of medical research into the effects of tobacco use on the human body provide a consistent picture of the pathophysiological effects. For example, it is almost universally accepted that long term smoking is extremely harmful to the smoker's health and may result or contribute to physiological conditions including lung problems, increased risk of cancer and heart disease. Ingestion of nicotine which results from burning tobacco and which occurs in the smoke is considered to be a major harmful ingredient and the basis for addiction to tobacco products. When tobacco is burned, a substantial amount of the nicotine in the tobacco product is volatilized and is carried in the tobacco smoke. When the smoke is inhaled by the smoker, the volatized nicotine in the smoke is rapidly absorbed through the respiratory system and into the human circulatory system. A small amount of nicotine may also be deposited in the saliva of the smoker and on the tissues of the mouth and tongue which deposits can cause harm to the mouth of the smoker.

The deleterious effects of tobacco are not limited to smoking products, but also extend to smokeless tobacco products, such as dry and moist snuff, as well as chewing tobacco. These products may also increase the risk of fatal heart attack, fatal stroke and certain cancers.

It has been proposed to find a substitute for tobacco which will be free of the harmful effects associated with tobacco and particularly with the nicotine and tars which are associated with tobacco in both smoking and smokeless products. A viable substitute would preferably look like, taste like, and have the aroma and flavor of tobacco in order to satisfy the psychological needs which may be associated with tobacco use.

In U.S. Pat. No. 2,930,719 to Finberg, issued Mar. 29, 1960, there is disclosed a wide variety of nicotine free products which are suggested for use in a tobacco-free smoking product including ingredients containing niacin and rutin. It is suggested that the smoking composition will not have a vascular-constricting effect. The disclosure does not, however, disclose specifically a composition which is substantially identical to the taste, aroma and flavor of tobacco containing smoking products.

U.S. Pat. Nos. 3,369,352 and 3,369,551, both to Carroll and each issued Feb. 20, 1968 disclose a process for preparing a smoking product and a smoking product which is a water and organic solvent extracted porous residuum of the leafy portion of a plant selected from the group consisting of lettuce, cabbage, broccoli, collard, kohlrabi, spinach and papaya plus added sweeteners, vitamins and other ingredients. The method of preparing is not simple in that there are several steps and the combination of ingredients is complicated by its number making it difficult to produce the flavor most appealing to smokers.

U.S. Pat. No. 3,034,931 of Kiefer discloses a substitute tobacco product made from sagebrush. In order to obtain a desirable flavor it is suggested that one should add paprika and turmeric.

U.S. Pat. No. 3,702,615 of Rozacky et al issued Nov. 14, 1972 discloses a non-tobacco smoking, chewing and dipping product of leaves of lettuce, spinach or cabbage. The process of producing the product involves multiple soaking and pressing steps, drying steps and requires the addition of additives in order to obtain the simulated tobacco taste and appearance.

U.S. Pat. No. 3,703,177 of Hind, issued Nov. 21, 1972 discloses a smoking product that is made from waste beet pulp which may be used alone or may be blended with tobacco. This product requires complicated cooking and refining steps and is generally not satisfactory to the smoker without the addition of additives such as tobacco itself.

Other patents disclosing tobacco substitutes or methods of modifying tobacco are: U.S. Pat. No. 3,112,754 issued Dec. 3, 1963; U.S. Pat. No. 3,106,209 of Torigian, issued Oct. 8, 1963; U.S. Pat. No. 3,575,177 of Briskin, issued Apr. 20, 1971 and U.S. Pat. Nos. 3,638,660, 3,705,589, 3,491,766, 2,943,958, 2,943,959, 2,907,686, 3,738,374, 3,100,492, 3,255,760, 3,545,448, 3,434,171, 3,323,524 and 3,720,660.

Because tobacco use is both physically and psychologically addictive, tobacco users have a very difficult time breaking the habit, even in the face of demonstrated medical and scientific evidence which supports the harmful effects of smoking. As an alternate smokers seek substitute smoking compositions and the prior art contains various compositions and processes for the manufacture of tobacco substitutes which are either low or devoid of nicotine and tar. Generally, tobacco substitutes manufactured by these processes have not achieved much success as they do not simulate the taste and appearance of tobacco and, therefore, those products do not have much commercial appeal. Further, many tobacco substitutes which are low in tar and nicotine are relatively expensive and may, in fact, introduce other substances which themselves are considered to be toxic or harmful.

It is highly desirable to obtain a simple combination of ingredients or a single ingredient, requiring little processing and/or chemical treatment and having the flavor, aroma, taste and characteristics of tobacco without the addition of harmful additives which combination of ingredients or ingredient is free from the harmful effects of tobacco but at the same time satisfies the desires of the tobacco user.

Accordingly, there is a demonstrated need for a tobacco substitute composition which contains reduced or no nicotine concentration which composition would be relatively safe to the tobacco user. Further, any such composition must be commercially satisfactory providing a taste, color, flavor, texture and other smoking qualities closely simulating tobacco products.

SUMMARY

In accordance with the purpose(s) of the invention, as embodied and broadly described herein, the invention, in one aspect, relates to composition suitable for use as a substitute or alternative to natural tobacco. The tobacco alternative can be used to prepare a combustible product or, alternatively, can be used as an alternative for tobacco products that are typically not combusted, including for example, smokeless tobacco products such as those defined herein.

In some aspects, disclosed are combustible products, comprising leafy material from one or more plants classified in the brassicaceae plant family, wherein the leafy material has not been subjected to an organic solvent extraction process, and wherein the leafy material has a predetermined moisture content such that it is suitable for use as a tobacco alternative in the manufacture of a smoking product.

In additional aspects, disclosed are combustible products, comprising leafy material from the *Brassica juncea* plant, wherein the leafy material has been treated to comprise a predetermined moisture content such that it is suitable for use as a tobacco alternative in the manufacture of a smoking product.

In further aspects, also disclosed are processes for the manufacture of a combustible product, comprising providing leafy material from one or more plants classified in the brassicaceae plant family; and drying the leafy material to remove moisture and to provide leafy material having a predetermined moisture content such that it is suitable for use as a tobacco alternative in the manufacture of a smoking product, wherein the leafy material suitable for use as a tobacco alternative has not been subjected to an organic solvent extraction process.

In still further aspects, also disclosed are processes for the manufacture of a combustible product, comprising providing leafy material from the *Brassica Juncea* plant; and drying the leafy material to remove moisture and to provide leafy material having a predetermined moisture content such that it is suitable for use as a tobacco alternative in the manufacture of a smoking product.

Additional advantages of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE FIGURES

The accompanying figures, which are incorporated in and constitute a part of this specification, illustrate several aspects and together with the description serve to explain the principles of the invention.

DETAILED DESCRIPTION

Figure 1:
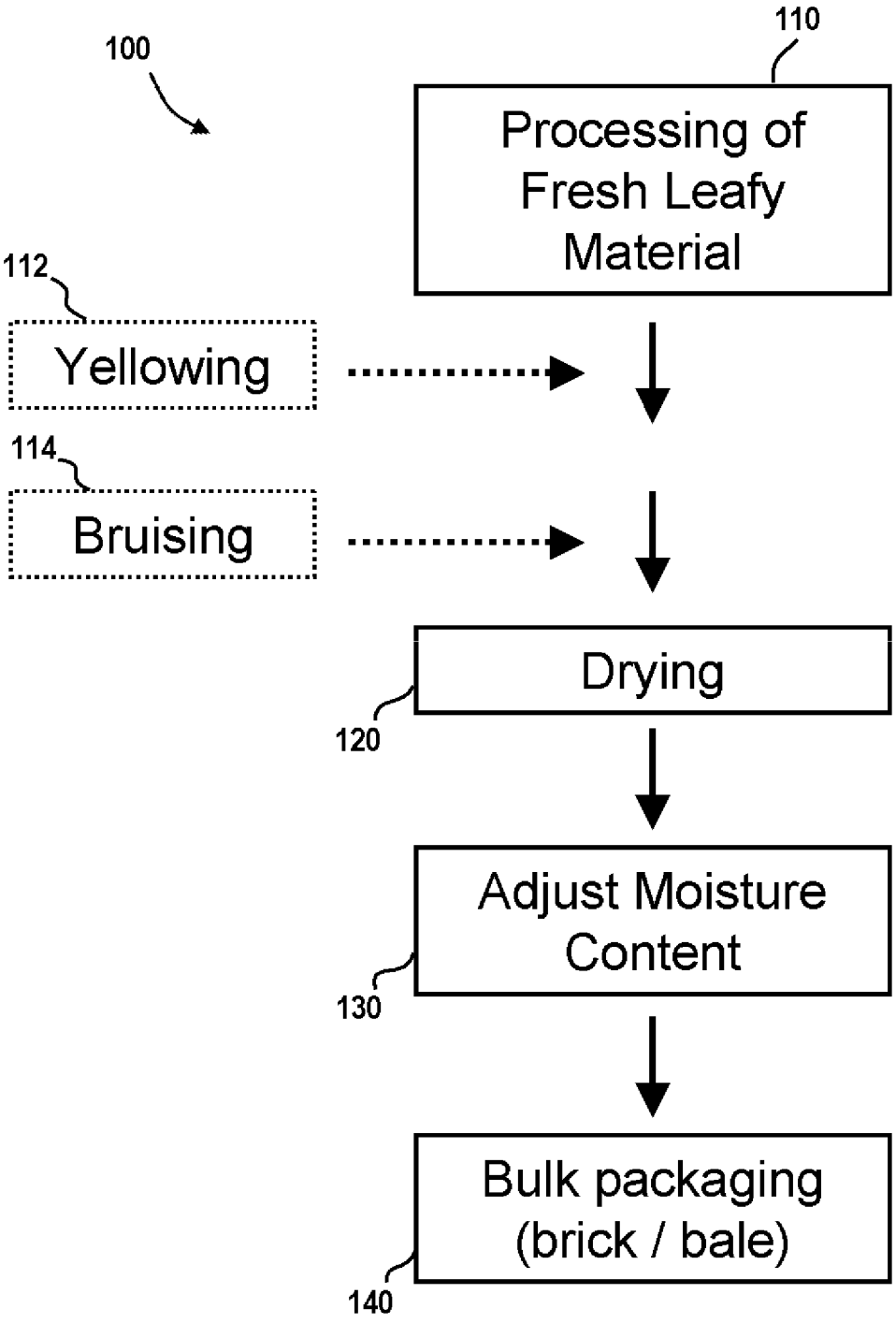
FIG. 1 is a schematic representation of a method of the present invention.

The present invention can be understood more readily by reference to the following detailed description of the invention and any Examples included therein. However, before the present compounds, compositions, articles, systems, devices, and/or methods are disclosed and described, it is to be understood that they are not limited to specific aspects and embodiments described herein as such may, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications are referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present invention is not entitled to antedate such publication by virtue of prior invention. Further, the dates of publication provided herein may be different from the actual publication dates, which can require independent confirmation.

A. Definitions

As used in the specification and the appended claims, the singular forms "a," "an" and "the" include plural referents unless the context clearly dictates otherwise. Thus, for example, reference to "a leafy material" can include mixtures of two or more such leafy materials and the like.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "flavor", "flavoring" and "flavorant" are used interchangeably whenever an organoleptic compound is referred to which is intended to stimulate the sense of taste.

As used herein, the terms "odorant", "odor", "fragrance" and "smell" are used interchangeably whenever a compound is referred to as an organoleptic which is intended to stimulate the sense of smell.

As used herein, the term "combustible product", "smoking article", "smokable tobacco" and "smoking product" are used interchangeabley, and means any combustible product or similar product for delivering an aerosol, such as smoke, to the consumer. Combustible products include conventional cigarettes, cigarette alternatives of the present invention, conventional cigars, cigar alternatives of the present invention, conventional cigarillos, cigarillos alternatives of the present invention, conventional pipe tobacco and pipe tobacco alternatives of the present invention, and similar articles.

As used herein, the term "non-combustible product", "smokeless article", "smokeless tobacco", "non-smokable tobacco", and "smokeless product" are used interchangeably, and means tobacco or the tobacco alternative of the present invention, that can be used by a consumer by positioning the tobacco or tobacco alternative into a cavity of the body. An example includes positioning the tobacco alternative in his or her mouth and holding it there over an extended period of time, during which the user's saliva mixes with the tobacco alternative and is then typically digested or expectorated, or spit out, after the flavor is enjoyed for a desired period of time. Certain forms of conventional smokeless tobacco include whole or partial pieces of tobacco leaves and are typically referred to as "chewing tobacco" or "chaw." A serving or "wad" of this form is commonly placed by a user inside his or her cheek. With respect to other forms of conventional smokeless tobacco, typically referred to as "snuff", "longcut" or "finecut" moist smokeless tobacco or "dip" tobacco, a serving of the tobacco, commonly referred to as a "pinch", is commonly placed by a user at a location between his or her lower lip and gum. Another form of smokeless tobacco that is also typically placed by a user between his or her lower lip and gum is a small saliva-permeable pouch in which snuff, longcut, finecut or dip tobacco is placed and retained during use. As will be described in more detail below, the tobacco alternative of the present invention can be used as a substitute for tobacco in any of the conventional smokeless products described above.

As used herein, the term "substantially" means that the subsequently described event or circumstance completely occurs or that the subsequently described event or circumstance generally, typically, or approximately occurs. For example, when the specification discloses that substantially all of an agent is released, a person skilled in the relevant art would readily understand that the agent need not be completely released. Rather, this term conveys to a person skilled in the relevant art that the agent need only be released to an extent that an effective amount is no longer unreleased.

As used herein, the term "tobacco article" is used in the conventional sense and includes smokable as well as non-smokable or smokeless forms in which tobacco is regularly used, e.g. cigarettes (either filtered or unfiltered), pipe tobacco, cigars, chewing tobacco, lozenges and loose tobacco.

As used herein, the term "vegetable-based tobacco substitute," "vegetable-based tobacco alternative," or "tobacco alternative" refers to the materials of the present invention, prepared as described herein from leafy plant material, which can be used in place of tobacco in both conventional smoking and smokeless products.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of embodiments described in the specification.

B. Vegetable-Based Materials

In one aspect, the vegetable-based tobacco substitute of the present invention comprises leafy material prepared from one or more species of plants in the family Brassicaceae or Cruciferae, which are commonly referred to as the crucifers, the mustard family, or the cabbage family. The family name Brassicaceae is the currently preferred name for the family, and comprises the older family name Cruciferae. According to ICBN Art. 18.5 (Vienna Code) both Cruciferae and Brassicaceae are regarded as valid botanical names for this family, and are thus accepted as names for the family. Plants of this family can be annual or perennial plants. Certain plants within this family can be characterized by alternate leaves without stipules and posses simple inflorescence or branched racemes. The flowers can be bilaterally symmetrical and hypogynous. The flowers of some plants within this family can also be characterized by having 4 petals (free) alternating with 4 sepals (free); 6 stamens (4 long and 2 short), an ovary of 2 united carpels with parital placenta, 2 locular through the formation of a membranous false septum. Fruit of certain plants within this family can be a dehiscent capsule opening by 2 valves. The family Brassicaceae comprise multiple genera, including, but not limited to, *Arabidopsis, Myagrum, Isatis, Bunia, Erysium, Hesperis, Malcolmia, Matthiola, Chorispora, Euclidium, Barbarea, Rorippa, Armoracia, Nasturtium, Dentaria, Cardamine, Cardaminopsis, Arabis, Lunaria, Alyssum, Berteroa, Lobularia, Draba, Erophila, Cochlearia, Camelina, Neslia, Capsella, Hornungia, Thlsapi, Iberis, Lepidium, Cardaria, Coronopus, Subularia, Conringia, Diplotaxis, Brassica, Sinapsis, Eruca, Erucastrum, Coincya, Hirschfeldia, Cakile, Rapistum, Crambe, Enarthrocarpus, Rhaphanus* and *Clausia*.

In a further aspect, Brassicaceae leafy materials comprises the leafy materials obtained from one or more of the *Brassica* genus within the family Brassicaceae. *Brassica* leafy materials can comprise leafy materials from one or a combination of leafy materials within the *Brassica* genus. The *Brassica* genus includes the mustard group within the *Brassica* genus, comprising *Brassica alba, Brassica hirta, Brassica juncea*, and *Brassica nigra*. Other examples for leafy materials from the *Brassica* genus include but are not limited to *Brassica adpressa, Brassica arvensis, Brassica campestris, Brassica cheiranthos, Brassica elongata*, subsp. *integrifolia, Brassica eruca, Brassica geniculata, Brassica kaber*, var. *pinnatifida, Brassica* var. *schkuhriana, Brassica napus, Brassica oleracea, Brassica orientalis, Brassica rapa*, and *Brassica toumefortii*. The genus- and species-names provided above comply with the International Code of Plant Nomenclature. In a still further aspect, the leafy materials comprise leafy materials obtained from one or more of *Brassica carinata* (Abyssinian Mustard or Abyssinian Cabbage), *Brassica elongata* (Elongated Mustard), *Brassica fruticulosa* (Mediterranean Cabbage), *Brassica juncea* (Indian Mustard, Brown and leaf mustards, Sarepta Mustard), *Brassica napus* (Rapeseed, Canola, Rutabaga (Swede Turnip), Nabicol), *Brassica narinosa* (Broadbeaked Mustard), *Brassica nigra* (Black Mustard), *Brassica oleracea* (Kale, Cabbage, Broccoli, Cauliflower, Kai-lan, Brussels sprouts, Kohlrabi), *Brassica perviridis* (Tender Green, Mustard Spinach), *Brassica rapa* (Chinese cabbage, Turnip, Rapini, Komatsuna), *Brassica rupestris* (Brown Mustard), *Brassica septiceps* (Seventop Turnip), and *Brassica tournefortii* (Asian Mustard).

In a further aspect, the leafy materials comprise leafy materials obtained from one or more of *Brassica oleracea* L. var. capitata DC (red cabbage), *Brassica oleracea* L. var. itarica Plen. (broccoli), *Brassica oleracea* L. var. otrytis gr. (cauliflower), *Brassica oleracea* L. var. gemmifera Zenher (baby cabbage), *Brassica oleracea* L. var. caulorapa DC (kohlrabi), *Brassica oleracea* L. var. acephala gr. (kale), *Brassica oleracea* L. var. acephala DC (ornamental kale), *Brassica rape* (red turnip), *Brassica nigra* (black mustard), *Brassica juncea* (leaf mustard), and other such plants belonging to *Brassica rapa*.

In a further aspect, the leafy materials comprise leafy materials obtained from one or more of *Raphanus sativus* L. (beet), *Raphanus sativus* var. radicula (radish), *Raphanus sativus* var. major (horseradish), *Raphanus sativus* var. niger (black radish), and other such plants belonging to *Raphanus sativus*.

In a further aspect, Brassicaceae leafy materials comprise leafy materials obtained from one or more plant species in the genera *Acanthocardamum, Aethionema, Agallis, Alliaria, Alyssoides, Alysopsis, Alyssum, Ammosperma, Anastatica, Anchonium. Andrzeiowskia, Anelsonia, Aphragmus, Aplanodes, Arabidella, Arabidopsis, Arabis, Arcyosperma, Armoracia, Aschersoniodoxa, Asperuginoides, Asta, Atelanthera, Athysanus, Aubrieta, Aurinia, Ballantinia, Barbarea, Beringia, Berteroa, Berteroella, Biscutella, Bivonaea, Blennodia, Boleum, Boreava, Bornmuellera, Borodinia, Botscantzevia, Brachycarpaea, Brassica, Braya, Brayopsis, Brossardia, Bunias, Cakile, Calepina, Calymmatium, Camelina, Camelinopsis, Capsella, Cardamine, Cardaminopsis, Cardaria, Carinavalva, Carrichtera, Catadysia, Catenulina, Caulanthus, Caulostramina, Ceratocnemum, Ceriosperma, Chalcanthus, Chamira, Chartoloma, Cheesemania, Cheiranthus, Chlorocrambe, Chorispora, Christolea, Chrysobraya, Chrysochamela, Citharelom, Clastopus, Clausia, Clypeola, Cochlearia, Coelonema, Coincya, Coluteocarpus, Conringia, Cordylocarpus, Coronopus, Crambe, Crambella, Cremolobus, Crucihimalaya, Cryptospora, Cuphonotus, Cusickiella, Cycloptychis, Cymatocarpus, Cyphocardamum, Dactylocardamum, Degenia, Delpinophytum, Descurainia, Diceratella, Dichasianthus, Dictyophragmus, Didesmus, Didymophysa, Dielsiocharis, Dilophia, Dimorphocarpa, Diplotaxis, Dipoma, Diptychocarpus, Dithyrea, Dolichirhynchus, Dontostemon, Douepea, Draba, Drabastrum, Drabopsis, Dryopetalon, Eigia, Elburzia, Enarthrocarpus, Englerocharis, Eremobium, Eremoblastus, Eremodraba, Eremophyton, Ermania, Ermaniopsis, Erophila, Eruca, Erucaria, Erucastrum, Erysimum, Euclidium, Eudema, Eutrema, Euzomodendron, Farsetia, Fezia, Fibigia, Foleyola, Fortuynia, Galitzkya, Geococcus, Glaribraya, Glastaria, Glaucocarpum, Goldbachia, Gorodkovia, Graellsia, Grammosperma, Guillenia, Guiraoa, Gynophorea, Halimolobos, Harmsiodoxa, Hedinia, Heldreichia, Heliophila, Hemicrambe, Hemilophia, Hesperis, Heterodraba, Hirschfeldia, Hollermayera, Hormathophylla, Hornungia, Hornwoodia, Hugueninia, Hymenolobus, Ianhedgea, Iberis, Idahoa, Iodanthus, Ionopsidium, Irenepharsus, Isatis, Ischnocarpus, Iskandera, Iti, Ivania, Kernera, Kremeriella, Lachnocapsa, Lachnoloma, Leavenworthia, Lepidium, Lepidostemon, Leptaleum, Lesquerella, Lignariella, Lithodraba, Lobularia, Lonchophora, Loxostemon, Lunaria, Lyocarpus, Lyrocarpa, Macropodium, Malcolmia, Mancoa, Maresia, Mathewsia, Matthiola, Megacarpaea, Megadenia, Menkea, Menonvillea, Microlepidium, Microsysymbrium, Microstigma, Morettia, Moricandia, Moriera, Morisia, Murbeckiella, Muricaria, Myagrum, Nasturtiopsis, Nasturtium, Neomartinella, Neotchihatchewia, Neotorularia, Nerisyrenia, Neslia, Neuontobotrys, Notoceras, Notothlaspi, Ochthodium, Octoceras, Olimarabidopsis, Onuris, Oreoloma, Oreophyton, Ornithocarpa, Orychophragmus, Otocarpus, Oudneya, Pachycladon, Pachymitus, Pachyphragma, Pachypterygium, Parlatoria, Parodiodoxa, Parolinia, Parrya, Parryodes, Pegaeophyton, Peltaria, Peltariopsis, Pennellia, Petiniotia, Petrocallis, Phaeonychium, Phlebolobium, Phlegmatospermum, Phoenicaulis, Physaria, Physocardamum, Physoptychis, Physorrhynchus, Platycraspedum, Polyctenium, Polypsecadium, Pringlea, Prionotrichon, Pritzelago, Pseuderucaria, Pseudoarabidopsis, Pseudocamelina, Pseudoclausia, Pseudofortuynia, Pseudovesicaria, Psychine, Pterygiosperma, Pterygostemon, Pugionium, Pycnoplinthopsis, Pycnoplinthus, Pyramidium, Quezeliantha, Quidproquo, Raffenaldia, Raphanorhyncha, Raphanus, Rapistrum, Reboudia, Redowskia, Rhizobotrya, Ricotia, Robeschia, Rollinsia, Romanschulzia, Roripella, Rorippa, Rytidocarpus, Sameraria, Sarcodraba, Savignya, Scambopus, Schimpera, Schivereckia, Schizopetalon, Schlechteria, Schoenocrambe, Schouwia, Scoliaxon, Selenia, Sibara, Silicularia, Sinapidendron, Sinapis, Sisymbrella, Sisymbriopsis, Sisymbrium, Smelowskia, Sobolewslia, Sohms-Laubachia, Sophiopsis, Sphaerocardamum, Spirorhynchus, Spryginia, Staintoniella, Stanfordia, Stanleya* (plant), *Stenopetalum, Sterigmostemum, Stevenia, Straussiella, Streptanthella, Streptanthus, Streptoloma, Stroganowia, Stubebdorffia, Subularia, Succowia, Synstemon, Synthlipsis, Taphrospermum, Tauscheria, Teesdalia, Teesdaliopsis, Tetracme, Thelypodiopsis, Thelypodium, Thlaspeocarpa, Thlaspi, Thysanocarpus, Trachystoma, Trichotolinum, Trochiscus, Tropidocarpum, Turritis, Vella* (plant), *Warea, Wasabia, Weberbauera, Werdermannia, Winklera, Xerodraba, Yinshania, Zerdana*, and *Zilla*.

In a still further aspect, the leafy materials of the present invention comprise leafy materials obtained from one or more plant species comprising *Acanthocardamum erinaceum, Aethionema cordifolia* (Lebanon stonecress), *Alliaria petiolata, Alyssum alyssoides, Anastatica hierochuntica* (Jericho Rose), *Anelsonia eurycarpa* (Daggerpod), *Arabidopsis thaliana, Arabis alpina* (Alpine Rockcress), *Armoracia rusticana* (Horseradish), *Athysanus pusillus* (Common Sandweed), *Aubrieta deltoidea* (Common Aubrieta or Wallcress), *Aurinia saxatilis, Barbarea vulgaris* (Winter Cress), *Biscutella rotgesii* (Lunetière de Rotgès), *Brassica juncea* (Indian Mustard), *Bunias erucago* (Crested warty cabbage), *Cakile maritime* (European Searocket), *Camelina sativa* (Camelina or False Flax), *Capsella bursa-pastoris* (Shepherd's Purse), *Cardamine amara* (Large Bittercress), *Cardaria draba* (Hoary Cress), *Caulanthus lasiophyllus* (California mustard), *Caulostramina jaegeri* (Cliffdweller), *Cheiranthus allioni* (Wall-flower), *Cochlearia anglica* (English Scurvy-grass), *Coincya wrightii* (Lundy Cabbage), *Conringia orientalis* (Hare's Ear Mustard), *Coronopus squamatus* (Greater swineweed), *Crambe maritime* (Seakale), *Cusickiella quadricostata, Degenia velebitica, Descurainia californica* (Sierra tansymustard), *Diplotaxis tenuifolia* (Perennial Wall-rocket), *Dithyrea californica* (Shieldpod or Spectacle-pod), *Draba sierrae* (Sierra draba), *Drabastrum alpestre* (Mountain Cress), *Eruca loncholoma,*

*Erucastrum gallicum* (Dog mustard), *Erysimum nevadense* (Sierra Nevada wallflower), *Euclidium tenuissimum, Eudema nubigena, Farsetia inconspicua, Fibigia macrocarpa, Guillenia lemmonii* (Lemmon's mustard), *Halimolobos diffusa* (Spreading fissurewort), *Heliophila coronopifolia* (Club-pointed Heliophilia), *Hemicrambe townsendii, Hesperis matronalis* (Dames-Wort), *Heterodraba unilateralis* (Ladiestongue Mustard), *Hirschfeldia incana* (Shortpod Mustard), *Hornungia alpine, Iberis sempervirens* (Evergreen Candytuft), *Idahoa scapigera* (Scalepod), *Lachnocapsa spathulata, Lepidium bonariense* (Peppercress), *Lepidium campestre* (Field Pepperwort or Field Cress), *Lesquerella fendleri* (Yellowtop), *Lobularia maritime, Malcolmia africana*, and *Matthiola maderensis.*

In one aspect, the vegetable-based tobacco substitute of the present invention comprises leafy materials prepared from one or more species of plants in the family Amaranthaceae. Most of the species in this family are herbs or shrubs. In APG II system (Angiosperm Phylogeny Group II system), of 2003 (the family is placed in the order Caryophyllales. It includes the plants formerly treated as the family Chenopodiaceae. In a further aspect, the family Amaranthaceae comprises plant species in either the family Amaranthaceae and Chenopodiaceae. Well-known chenopodioid species include beet, goosefoot, quinoa, and spinach.

In a further aspect, the leafy materials obtained from plants in the family Amaranthaceae comprise one or more of plants in the genera *Achyranthes, Achyropsis, Aerva, Amaranthus, Arthraerua, Calicorema, Celosia, Centema, Centrostachys, Cyathula, Hermbstaedtia, Kyphocarpa, Leucosphaera, Marcelliopsis, Nelsia, Nothosaerva, Pandiaka, Psilotrichum, Pupalia, Sericocoma*, and *Sericorema.*

In a further aspect, the leafy materials obtained from plants in the family Amaranthaceae comprise one or more of plants in the genera *Acroglochin, Agathophora, Agriophyllum, Alexandra, Allenrolfea, Anabasis, Anthochlamys, Aphanisma, Archiatriplex, Arthrocnemum, Arthrophytum, Atriplex, Axyris, Babbagia, Bassia, Beta, Bienertia, Borsczowia, Brachylepis, Camphorosma, Ceratocarpus, Chenopodium, Choriptera, Climacoptera, Corispermum, Cornulaca, Cremnophyton, Cyathobasis, Cycloloma, Didymanthus, Dissocarpus, Dysphania, Einadia, Enchylaena, Eremophea, Eriochiton, Esfandiaria, Exomis, Fadenia, Fredolia, Girgensohnia, Goerziella, Grayia, Gyroptera, Hablitzia, Halanthium, Halarchon, Halimione, Halimocnemis, Halocharis, Halocnemum, Halogeton, Halopeplis, Halosarcia, Halostachys, Halothamnus, Haloxylon, Hammada, Helicilla, Hemichroa, Heterostachys, Holmbergia, Horaninovia, Kalidiopsis, Kalidium, Kirilowia, Kochia, Krascheninnikovia, Lagenantha, Maireana, Malacocera, Manochlamys, Microcnemum, Microgynoecium, Monolepis, Nanophyton, Neobassia, Nitrophila, Noaea, Nucularia, Ofaiston, Oreobliton, Pachycornia, Panderia, Patellifolia, Petrosimonia, Piptoptera, Polycnemum, Rhagodia, Roubieva, Roycea, Salicornia, Salsola, Sarcobatus, Sarcocornia, Sclerochlamys, Sclerolaena, Sclerostegia, Seidlitzia, Senniella, Sevada, Spinacia, Stelligera, Suaeda, Suckleya, Sympegma, Tecticornia, Tegicornia, Teloxys, Threlkeldia, Traganopsis, Traganum*, and *Zuckia.*

In a further aspect, the leafy materials obtained from plants in the family Amaranthaceae comprise one or more of plant species in the genera *Spinacia* including, but not limited to, *Spinacia divaricata, Spinacia domestica, Spinacia fera, Spinacia glabra, Spinacia inermis, Spinacia littoralis, Spinacia minor, Spinacia oleracea, Spinacia sessiliflora, Spinacia spinosa, Spinacia tetrandra*, and *Spinacia turkestanica.*

In still further aspects of the present invention, the leafy plant material can be obtained from plants in the family pea family Fabaceae. Plants in this family include the subfamily Faboideae. Plants in this subfamily include the genus of plants referred to as *Pueraria*. The genus *Pueraria* includes species such as the *Pueraria montana, Pueraria lobata, Pueraria edulis, Pueraria phaseoloides, Pueraria thunbergiana*, and *Pueraria thomsoni*. These species of leafy plants are commonly referred to as *Kudzu.*

C. Methods of Making

Various methods and processes exist for preparing the vegetable-based tobacco substitutes of the present invention from the plant leafy material. In one aspect, the method of preparing the vegetable-based tobacco substitute of the present invention comprises the steps schematically represented in FIGS. 1 and 2, with optional steps indicated by boxes with dashed lines. As shown, an exemplary method 100 can comprise the steps of obtaining and processing fresh leafy material 110 from any one or more of the plants described herein; drying the plant material 120 (which can also be referred to as curing); adjusting the post-drying moisture content 130 to a predetermined value; bulk packaging the leafy material 140 into bricks or bales; processing the bulk packaged leafy material by grinding, shredding, or cutting 150; pre-product processing 160 which can comprise an additional optional treatment with water by spraying or steaming 162, the addition of one or more optional flavorant 164, and the additional addition of one or more optional odorant 166; and subsequent end product manufacturing 170.

In one aspect, the processing of the obtained leafy material can comprise removal of the midrib (backbone stem) from the lamina (each individual leaf). The separation of the midrib from lamina can be carried out by hand or using machinery typically used in the tobacco industry for separation of the midrib and lamina of tobacco leaves.

In a further aspect, the processing step can further comprises the optional step of yellowing the leafy material prior to drying 112. If a yellowing process is used, the leafy material is preferably harvested in a fully developed and mature state. The leafy material can be at least partly yellow when harvested, possibly having been yellowed by the application of an externally applied agent that causes or accelerates yellowing of the leaves on the plant. Yellowing can take place, for example, by heaping the leafy material in piles in an enclosed controlled atmosphere. For example, in one aspect, the controlled atmosphere can have a relative humidity of about 70% or more and a temperature in the range of about 20°-40° C. The piles during yellowing can be checked at various intervals to ensure that spontaneous heating that can occur therein does not subject any of the leaves to unduly high temperatures. The piles may be re-made a number of times to ensure an even yellowing of the leaves. Ethylene gas can also be introduced into the atmosphere to promote the yellowing process. As an alternative to heaping the leafy plant material in piles, they may be hung in racks in a similar atmosphere. The yellowing process can usually be completed within a period of about 24-72 hours, but the time required can of course vary. The moisture content of fully yellowed leafy material prior to drying is typically in the range of about of 70%-90% by weight but can, of course, vary.

In a further aspect, processing can comprises the step of bruising the leafy material prior to drying 114. The leafy material can be subjected to bruising mechanically so as to cause the sap of the leaf cells to transude and to come in contact with the open air, and thereby the browning reaction of the leafy material can be uniformly promoted as a whole. The mechanical bruising of the leafy material may be accomplished either by crushing of the yellowed leafy material in a kneader or the like or by passing the leaf several times through pairs of pressing rollers. Such bruising operation can be carried out at least to such an extent that the whole of the leaf tissue contains moisture uniformly and appears as if water has soaked therein (in other words to such an extent that either the volume of the gas contained in the leaf is reduced to about half of its initial volume or until the leaf turns translucent). The specific time required for the bruising operation on the leafy material is can be in the range of from a few minutes to 2 hours, varying with the character of the leaf to be treated, apparatus used, temperature and other factors known to those of ordinary skill in the art.

After processing, the leafy material is then dried. In one aspect, the leafy material can be dried in a conventional dehydrator or smoker. In a further aspect, during the drying process, wood chips can be introduced to the smoker or other drying apparatus to impart a desired flavor or odor characteristics to the dried leaves. To that end, in a yet further aspect, the wood chips can comprise any desired wood, such as wood obtained from one or more of cherry, pecan, alder, mesquite, maple, hickory, oak, and apple trees. In an even further aspect, the drying process comprises use of a non-wood material to impart flavor and odor characteristics comprising one or more of corncobs, peat, rice, sugar, tea, and coffee. The drying process is continued until the moisture content of the leaves is in the range of from about 0%-10% by weight. In a further aspect, the water content can be any amount within this range, including such values as about 0%, 1%, 2%, 3%, 4%, 5%, 6%, 7%, 8%, 9% and 10% by weight, and any range derived from these values. The step of drying can be performed under ambient conditions without the addition of external heat or increased temperatures. Alternatively, drying can be performed by heat treatment of the leaves using any conventional drying means typically used in the tobacco industry. When drying is performed by heat treating the leaves, the drying temperature can be in the range of about 100° F.-250° F., including exemplary temperatures of about 100° F., 110° F., 120° F., 130° F., 140° F., 150° F., 160° F., 170° F., 180° F., 190° F., 200° F., 210° F., 220° F., 230° F., 240° F. and 250° F., and any range of temperatures derived from these values.

As noted above, drying of the leafy material can be accomplished by any conventional means for drying that is typically used in the tobacco industry, including without limitation air curing, heat treating, fire curing, flue curing, sun curing, and smoke curing. Air curing typically comprises hanging the leaves from tier-poles in a well ventilated structure and allowing the leaves to dry for about 3 days-10 weeks. The structure can comprise a tobacco curing barn. Fire curing comprises hanging the leaves in a structure where fires of hardwoods are kept on continuous or intermittent low smolder allowed to dry for about three days to ten weeks. Flue curing comprises placing the leaves in a ventilated structure in a curing barns. The curing barn comprises flues connected to an externally-fed fire boxes. The temperature is slowly increased during the period of drying and the process occurs for about 5-14 days. Sun curing comprises placing the leaves on racks or similar device to expose the leaves to direct sunlight. Smoke curing comprises the steps described above. The choice of drying method is determined by multiple factors, including, but not limited to, leaf type, moisture content, desired characteristics of the product made from the leafy material, and environmental factors.

After the initial drying, the moisture content of the dried leafy material can be optimized or adjusted to any predetermined level suitable for use in a desired end product. For example, according to aspects of the invention, the moisture content of the dried leafy material can be adjusted to a moisture content in the range of about 55%-70% by weight. In a yet further aspect, the moisture content of the dried leafy material can be adjusted to about 10-24% by weight. In a still further aspect, the moisture content is adjusted to about 12-16% by weight. In an even further aspect, the moisture content is adjusted to about 14% by weight. In a yet further aspect, the moisture is adjusted to about 10%, 11%, 12%, 13%, 14%, 15%, and 16%.

The dried leafy material having the desired predetermined moisture content can then be condensed into a cylindrical, block-shaped, brick-shaped or otherwise configured bulk packages (hereinafter called bales for short). The bales of leafy material are then suitable as the input material for further processing and manufacture into desired combustible or smoking articles as well as smokeless articles.

Figure 2:
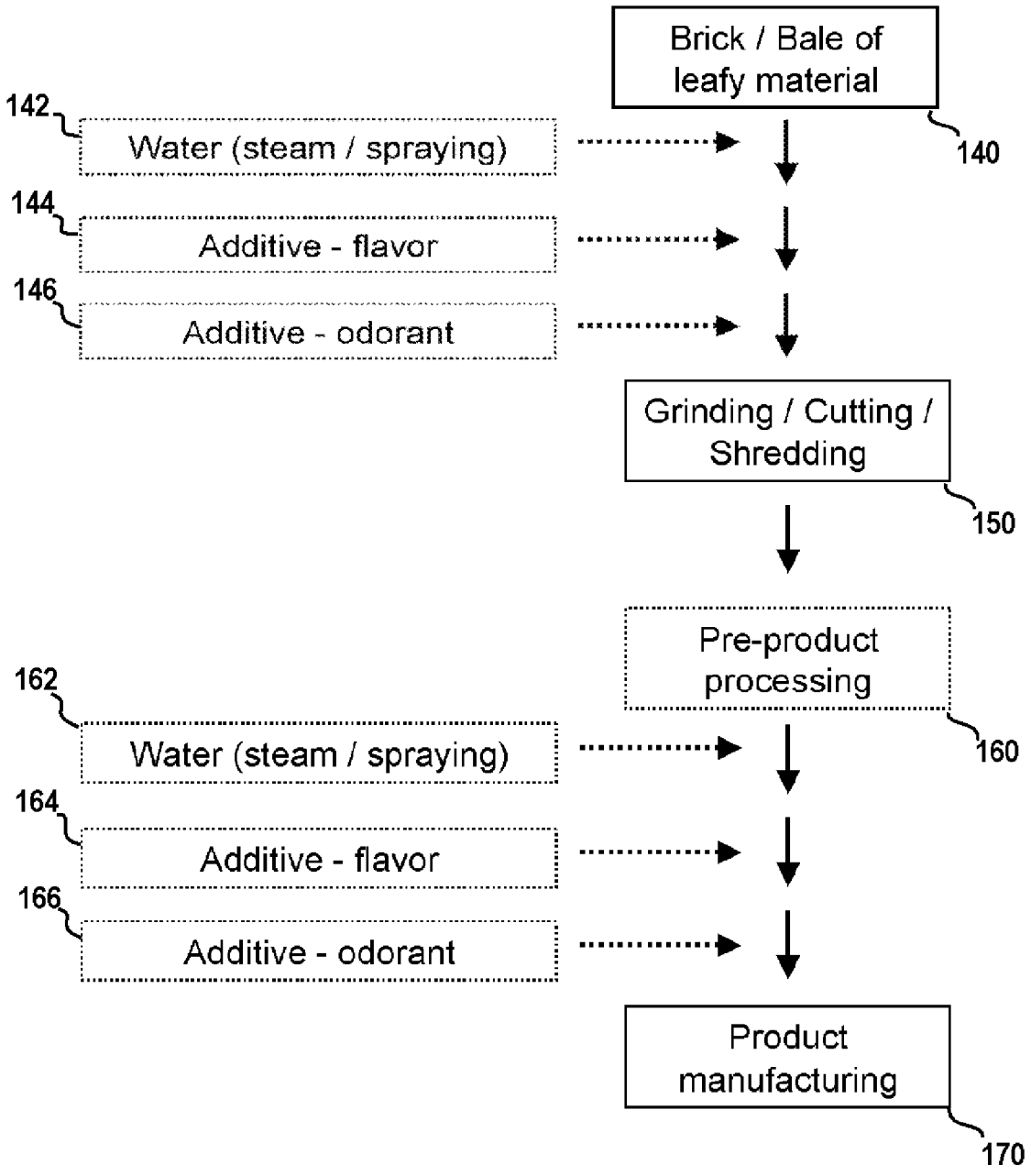
FIG. 2 is a schematic representation of a method of the present invention.

The bales can then be further processed to provide leafy tobacco alternative material that is suitable for handling in the production of the desired end use smoking and/or smokeless article. For example, when the leafy plant material within a bale is intended for use as a tobacco alternative in the manufacture of cigarette alternative rods in accordance with heretofore conventionally known procedures, the bales can be broken up, i.e., the relatively coherent and packed leafy material can be singularized and separated. The reason for this step is that, according to some aspects of the invention, the relatively dry and hence brittle leafy material in the bale an strongly adhere to each other. Accordingly, the component leafy material in the bales can be subjected to a conventional machine separation and cutting. In a further aspect, a bale can be introduced into a vacuum chamber where one or more hollow mandrels can be driven into the bale The hollow mandrels can serve to introduce optional moisture, for example in the form of steam, as illustrated in FIG. 2 as optional step 142. The admission of steam into the chamber can result in heating and moisturizing of the leafy material so that the leafy material becomes more supple and is more readily separable from each other. Reference may be had, for example, to U.S. Pat. No. 3,372,703. As a rule, the apparatus can raise the moisture content of leafy material within a bale to approximately 12-14 percent which is considered an acceptable value for enhancing the suppleness of the particles and for facilitating their separation without undue breakage. Such preliminary moisturizing to between 12 and 14 percent can also be followed by additional moisturizing in order to raise the moisture content to even higher levels, including for example, in the range of from about 18 and 23 percent. This is considered by experts to be an optimum moisture content of leafy particles that are about to be ground, cut, or shredded.

Any conventional tobacco cutter can be used to size reduce the leafy material that has been separated from the bales. For example, a typical tobacco cutter operates with two convergent chains which subject the moisturized leafy material to a pronounced compressing action to form a so-called cake which is then fed through a mouthpiece and into the range of a set of orbiting knives serving to convert the leader of the cake into cut or comminuted leaf material in the form of shreds. The shreds can thereupon be dried in order to reduce their moisture content back to a predetermined value, such as for example, between 12.5 and 13.5 percent, which is well suited for gathering of shreds of leafy material into a stream in a conventional cigarette rod making machine.

The above outlined steps of a conventional method of breaking up bales and of converting their particles into shreds which are ready for the making of tobacco alternative cigarette fillers involve heating and moisturizing, additional moisturizing, pronounced compacting in the cutter and subsequent drying. The leafy material, thus prepared, is ready for use in the next steps of the manufacturing stream, the pre-product processing step, which can optionally include further moisturizing, optional addition of one or more flavorants, and optional addition of one or more odorants. In one aspect, moisture can be adjusted as desired for the final desired product. For example, if the desired product is a smokeless article that is chewed, the moisture content may be increased by spraying water or application of steam in a manufacturing line thus increasing the moisture content to any desired value, such as for example, into the range of about 30%-70% by weight.

As noted above and illustrated in the attached Figures, an optional flavorant can be added to the leafy material at various stages of the manufacturing process. For example, flavorant can be added during the pre-product processing steps after the baled leafy material has been processed and sized reduced by cutting, shredding, or grinding. Alternatively, flavorant can be added during the processing of the bulk packaged bales of leafy material as illustrated for example in FIG. 2 as optional step 144. Still further, flavorant can be added to the leafy material during the initial drying step or during the moisture adjustment steps. To that end, one of ordinary skill in the art will understand that the flavorant can be introduced during any desired step of the manufacturing process, including during those steps that correspond to when flavorant is conventionally added to tobacco products in the tobacco industry.

Any conventional flavorant commonly used in the tobacco industry can be used in connection with the present invention. Such flavorants are customizable to provide any desired flavor and taste to the end use product and are commercially available through a number of sources. One of ordinary skill in the art will be able to determine and obtain a suitable flavorant, if desired, without requiring any undue experimentation.

When introduced directly to the leafy material, the flavorant may be added as a component within a flavorant mixture that also comprises a solvent or combination of solvents utilized as a deliverant or vehicle for introducing the flavorant. Suitable examples of solvents include glyceryl triacetate, propylene glycol, ethanol, or triethylene glycol diacetate, or any combination thereof. The amount of flavorant that is to be added is also variable based upon the desired strength. As such, one of ordinary skill in the art will readily be able to determine the specific amount of flavorant that is to be used, as well as the specific deliverant or solvent vehicle for use in applying the flavorant without requiring any undue experimentation. However, in an exemplary aspect, and without limitation, a suitable flavorant can be applied to the leafy material in an amount in the range of from about 0.05 weight % to about 0.15 weight % relative to the weight of leafy material, including exemplary amounts of 0.06 weight %, 0.07 weight %, 0.08 weight %, 0.09 weight %, 0.10 weight %, 0.11 weight %, 0.12 weight %, 0.13 weight %, and 0.14 weight %. As noted above, the desired amount of flavorant can be diluted in the desired solvent, such as for example, a mixture of ethanol and propylene glycol. The desired amount of flavorant, diluted in the solvent or solvent mixture, can then be sprayed on the leafy material at the desired stage of the process.

In alternative aspects, it should be understood that during the manufacture of a smoking article in addition to or as an alternative to the leafy tobacco alternative material, a flavorant can be added to the paper used to roll the cigarette alternative or cigar alternative, the tipping paper, packaging paper/foil, or the seam adhesive, or any combination thereof. In an exemplary and non-limiting aspect, a flavorant such as menthol is commonly applied to the filter of the smoking article. For application to the filter, the flavorant can again be dissolved in a suitable solvent or deliverant, for example, glyceryl triacetate, propylene glycol, ethylpropyl glycol, ethanol, or triethylene glycol diacetate, or any combination thereof. The amount of flavorant used in the smoking article filter will depend upon the chemical and physical properties of the flavorant, as well as the desired flavorant characteristics desired in the product. In an exemplary aspect and without limitation, the flavorant solution can be applied to the filter in an amount to provide between approximately 0.1 mg and 10.0 mg flavorant per smoking article filter when the smoking article is configured as a cigarette alternative. For use in smoking articles of the cigar type, an amount of flavorant which provides between about 1 to 25 mg flavorant per filter can be used.

The amount of flavorant used in the filter or on the leafy material is primarily dependent on the amount of flavorant perception desired in the final product. For example, and without limitation, if only a flavorant nuance is desired, then in some aspects an amount used can be less than about 5 mg flavorant per cigarette alternative. If the objective is to provide a cigarette alternative or other smoking article with a predominant flavorant character, then in some aspects and amount of about 5 mg flavorant or more per cigarette alternative can be used.

Other conventional additives, including conventional odorants or aroma compounds can also be added during the production of a smoking and/or smokeless article of the present invention. The odorant can serve to enhance or mask the smoking odors depending upon selection and use levels of the compounds. Conventional odorants typically comprise one or more organoleptic compounds, including, for example, alcohols, aldehydes, ketones, nitriles, esters, and frequently hydrocarbons so that the one or more (when combined) odors of the individual components produce a pleasant or desired fragrance during use of the product. A wide variety of odorant additives are commercially available for use in the tobacco industry, any of which are suitable for use in connection with the tobacco alternatives of the present invention. For example, among the palette of organoleptic properties that can be provided by commercially available odorants are floral, fruity, sweet, herbaceous, balsamic, spicy, cinnamon, woody, cocoa, and vanillin notes. In similar fashion to the addition of flavorants discussed above, one of ordinary skill in the art will be able to determine and obtain a suitable odorant, if desired, without requiring any undue experimentation. Additionally, the amount of odorant to be used will depend upon the chemical and physical properties of the odorant as the desired aromatic characteristics desired in the final product and such determination will similarly be readily available to the skilled artisan without requiring any undue experimentation.

As noted above and illustrated in the attached Figures, an optional odorant can be added to the leafy material at various stages of the manufacturing process. For example, odorant can be added during the pre-product processing steps after the baled leafy material has been processed and sized reduced by cutting, shredding, or grinding. Alternatively, odorant can be added during the processing of the bulk packaged bales of leafy material as illustrated for example in FIG. 2 as optional step 146. Still further, odorant can be added to the leafy material during the initial drying step or during the moisture adjustment steps. To that end, one of ordinary skill in the art will understand that the odorant can be introduced during any desired step of the manufacturing process, including during those steps that correspond to when odorant is conventionally added to tobacco products in the tobacco industry.

D. Articles

Various articles can be prepared from the disclosed tobacco alternative compositions. For example, the tobacco alternative of the present invention can be used to prepare cigarette alternatives. In further aspects, the tobacco alternatives can be used a tobacco substitute in the manufacture of cigarillos and cigars. When utilized in the manufacture of cigars, it should also be understood that the dried leafy material of the present invention is suitable for use as a substitute for the tobacco rolling leaves as well as the combustible tobacco compositions rolled within the leaves. In still further aspects, the tobacco alternatives of the present invention are suitable for use in a conventional smoking pipe. In still further aspects, the articles can comprise smokeless articles comprising chaw, chewing tobacco substitute, snuff and the like. For all of the various articles and uses stated above, the articles can be prepared according to conventionally known processes and methods utilizing the tobacco alternatives of the present invention as a substitute for the conventional tobacco currently used. Therefore the specific details of cigarette and cigar manufacture are not discussed herein.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A combustible product, comprising:

shredded leafy material from the *Brassica Juncea* plant, wherein the leafy material has not been subjected to an organic solvent extraction process, wherein the leafy material does not comprise *Brassica oleracea* and wherein the leafy material has a predetermined moisture content such that it is suitable for use as a tobacco alternative in the manufacture of a smoking product; and a tobacco flavorant that simulates a flavor of a conventional tobacco containing combustible product.

2. The combustible product claim 1, wherein the predetermined moisture content of the leafy material is in the range of from approximately 10 weight percent to 25 weight percent.

3. The combustible product of claim 1, further comprising a humectant.

4. The combustible product of claim 1, further comprising a burn aid.

* * * * *